US007025203B2

(12) United States Patent
Schönenbach

(10) Patent No.: US 7,025,203 B2
(45) Date of Patent: Apr. 11, 2006

(54) PORTABLE CARRYING GUN CASE WITH FLEXIBLE HOLDING TAPES

(75) Inventor: Heinrich R. Schönenbach, Remscheid (DE)

(73) Assignee: Parat-Werk Schonenbach GmbH & Co. KG, Remscheid (DE)

( * ) Notice: Subject to any disclaimer, the term of this patent is extended or adjusted under 35 U.S.C. 154(b) by 0 days.

(21) Appl. No.: 10/638,120

(22) Filed: Aug. 8, 2003

(65) Prior Publication Data

US 2004/0104137 A1 Jun. 3, 2004

(30) Foreign Application Priority Data

Aug. 15, 2002 (DE) ..... 102 38 155

(51) Int. Cl.
*B65D 85/00* (2006.01)

(52) U.S. Cl. ..... 206/317; 206/315.11; 206/478; 206/488

(58) Field of Classification Search ..... 206/315.11, 206/317, 478–479, 488–489, 495; 224/913
See application file for complete search history.

(56) References Cited

U.S. PATENT DOCUMENTS

| | | | | |
|---|---|---|---|---|
| 2,519,662 A | | 8/1950 | Kempken | |
| 2,531,550 A | * | 11/1950 | Bradley et al. | 206/317 |
| 3,669,336 A | * | 6/1972 | Robinson | 206/317 |
| 3,780,487 A | * | 12/1973 | Munson | 206/317 |
| 3,907,108 A | | 9/1975 | Weimer | |
| 4,480,774 A | | 11/1984 | Smith | |
| 4,523,702 A | | 6/1985 | Viio | |
| 5,366,070 A | | 11/1994 | Wolov | |
| 5,678,686 A | * | 10/1997 | Hagemann et al. | 206/315.11 |
| 5,845,780 A | | 12/1998 | Allen | |
| 6,009,996 A | | 1/2000 | Purdy | |
| 6,499,592 B1 | * | 12/2002 | Wilfer | 206/314 |
| 6,547,070 B1 | * | 4/2003 | Kolpin | 206/317 |
| 2001/0015325 A1 | | 8/2001 | Wilfer | |

FOREIGN PATENT DOCUMENTS

| | | |
|---|---|---|
| DE | 298 18 077 | 2/1999 |
| FR | 2586766 | 3/1987 |

* cited by examiner

*Primary Examiner*—Bryon P. Gehman
(74) *Attorney, Agent, or Firm*—Herbert Dubno; Andrew Wilford

(57) ABSTRACT

A portable gun case has a generally rectangular floor wall having two long side edges and two short end edges bridging the side edges, respective side and end walls projecting upward from the respective edges of the floor wall and forming an upwardly open cavity, and a top wall secured to one of the side walls and engageable down over the cavity. A mounting board fitted to one of the walls in the cavity is adapted to support parts of a gun. A plurality of flexible holding tapes are each mounted releasably at any of a plurality of locations on the board so the tapes can be wrapped around the parts of the gun and thereby securing the gun to the board.

12 Claims, 5 Drawing Sheets

PORTABLE CARRYING GUN CASE WITH FLEXIBLE HOLDING TAPES

FIELD OF THE INVENTION

The present invention relates to a portable gun case. More particularly this invention concerns an adjustable portable carrying case for a takedown long arm, e.g. rifle or shotgun.

BACKGROUND OF THE INVENTION

A gun case as described in U.S. Pat. No. 2,519,662 of Kempken has a hard two-part shell forming an elongated and generally parallepipedal cavity. Transverse bars in the cavity are each provided with a plurality of holding brackets that can be positioned along the bars so as to fit with the long arm to be held in the case.

Another gun case described in U.S. Pat. No. 3,780,487 of Munson is of the same shape, but instead is provided with fixed molded blocks custom made to fit with a particular long arm or its parts. Such a case can be produced at relatively low cost, but only fits a single gun or line of guns.

German Utility Model 298 18 077 assigned to Limtec GmbH describes another gun case adapted to be carried like a backpack and provided with hook/loop (e.g. Velcro™) tapes used to secure the parts of a takedown gun in place.

These cases all have in common that they are fairly expensive to manufacture and are normally also at least partially custom made for certain types or sizes of guns. Adapting them to different guns is difficult and refitting the box to accommodate a different gun is even more difficult.

OBJECTS OF THE INVENTION

It is therefore an object of the present invention to provide an improved portable gun case.

Another object is the provision of such an improved portable gun case which overcomes the above-given disadvantages, that is which is inexpensive to manufacture and very easy to adapt to guns of different sizes, in particular takedown long arms.

SUMMARY OF THE INVENTION

A portable gun case has according to the invention a generally rectangular floor wall having two long side edges and two short end edges bridging the side edges, respective side and end walls projecting upward from the respective edges of the floor wall and forming an upwardly open cavity, and a top wall secured to one of the side walls and engageable down over the cavity. In accordance with the invention a mounting board fitted to one of the walls in the cavity is adapted to support parts of a gun. A plurality of flexible holding tapes are mounted releasably at any of a plurality of locations on the board so the tapes can be wrapped around the parts of the gun and thereby securing the gun to the board.

The use of flexible tapes, of the hook/loop type that have hook/loop ends that stick to each other or with an eye at one end, makes it possible to not only lock the tapes around any part of the gun having any normal dimension, but also facilitates securing the tapes to the board. What is more, the tapes secure the weapon in the case even without the case being closed, thereby making using the case much simpler. Opening the case and taking out one part of the gun, for instance to switch barrels or get a telescopic sight, is easy because everything remains held solidly in place when the case is open. All the user has to do is undo the tapes of the part wanted to gain access to it.

According to the invention the board is formed with an array of slots through which the tapes are looped. These slots are arrayed in parallel rows and each slot is throughgoing and has a length equal to slightly more than a width of the tapes. The board also has hook/loop regions engaging the tapes and releasably secured thereto. Thus to fit the case according to the invention with a particular gun, its parts are laid down at a spacing to each other on the panel. Then the tapes are threaded through the slots between the parts, automatically adhering to the board, and are overlapped and pressed together atop the gun parts. The board is then fitted to the case.

The board is rigid and has a face turned toward the one wall and the board face and the one wall are provided with complementary hook/loop, that is hook-and-loop, strips that removably secure the board to the one wall. Thus the board can be pulled out, if necessary, and the tapes moved around to accommodate another gun or another part of the gun already being held. The use of a separate board means that, now matter how the tapes are set for a particular gun, the case will have the same outside appearance, as the tapes are nowhere visible outside the case. What is more, this board stiffens the entire case, so that the side and end walls as well as the floor and cover can be made of somewhat lighter stock.

The walls can all be folded flat. More specifically the side walls and end walls are permanently hinged on the floor wall and the top wall is permanently hinged on one of the side walls. Thus cases according to the invention can be shipped flat, in quantity to the end user who can set them up as they are needed, one gun per case normally. The cases are so expensive that guns can be individually packaged in them for inventory purposes or to move them about, and the cases themselves can be used for display, e.g. at a gun show.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
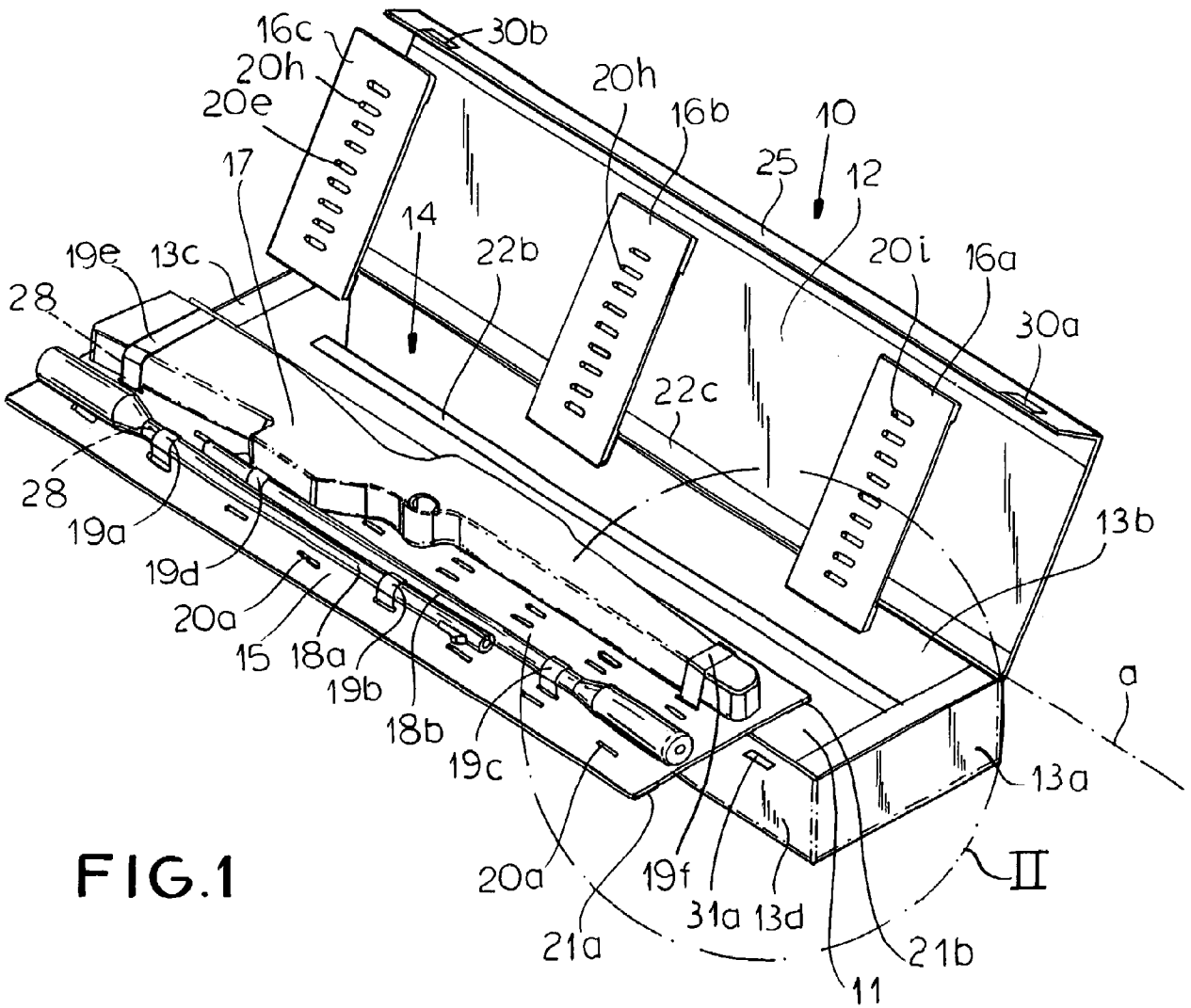
FIG. 1 is a perspective view of the case according to the invention.
Figure 2:
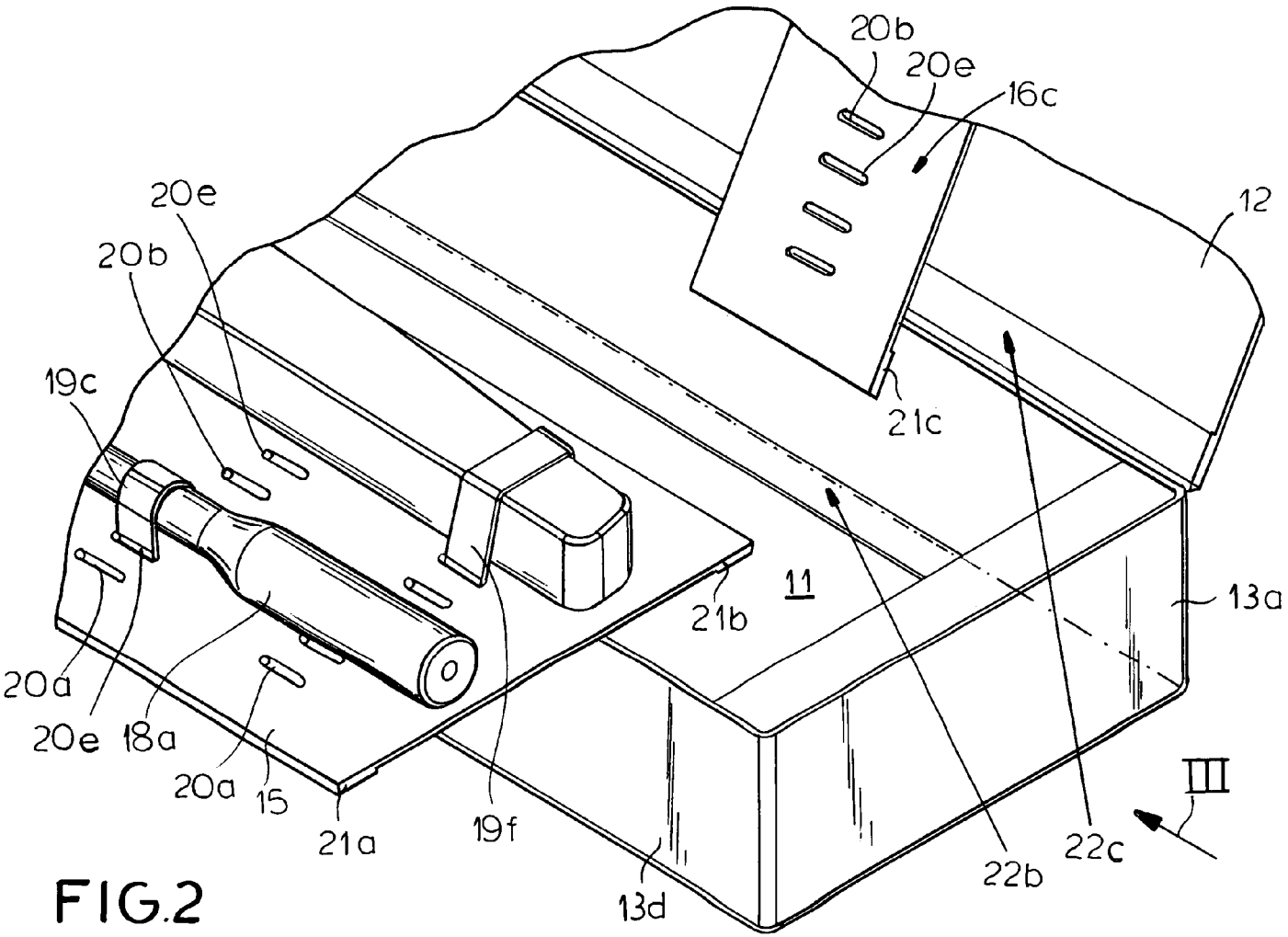
FIG. 2 is a large-scale view of the detail indicated at II in FIG. 1.

As seen in FIG. 1 a portable case 10 according to the invention is of elongated parallepipedal shape and has a planar floor 11, a planar top wall or cover 12, short end walls 13*a* and 13*c* extending upward from short edges of the floor 11, and long side walls 13*b* and 13*d* bridging the end walls 13*a* and 13*c* and extending upward from long edges of the floor 11. The floor 11, top 12, and walls 13*a–d* together form a storage compartment 14.

Figure 5:
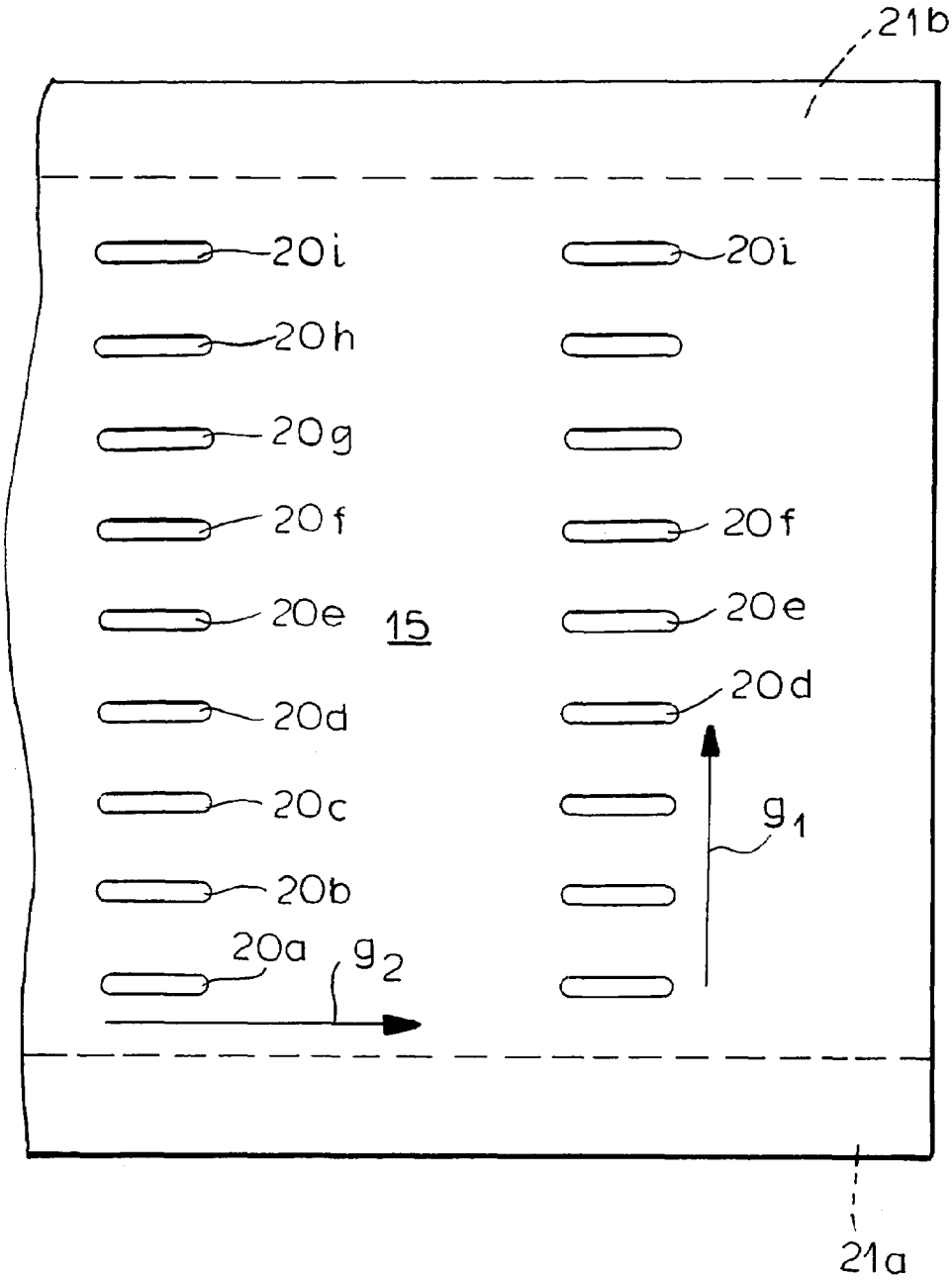
FIG. 5 is a large-scale top view of the floor liner of the case.

The floor 11 is covered by a liner board 15 of slightly smaller dimensions so it fits snugly between the walls 13*a*–13*d*. This board 15 is formed with eight rows of nine slots 20*a*–20*i* (FIG. 5 also), the rows being equispaced and extending in a direction $g_1$ and the slots being equispaced in a transverse direction $g_2$. Strip 21*a* and 21*b* of hook/loop tape extending along the long edges on the bottom face of the board 15 secure it to complementary strips 22*a* and 22*b* of hook/loop tape fixed to the floor 11 along the long edges thereof.

Figure 6:
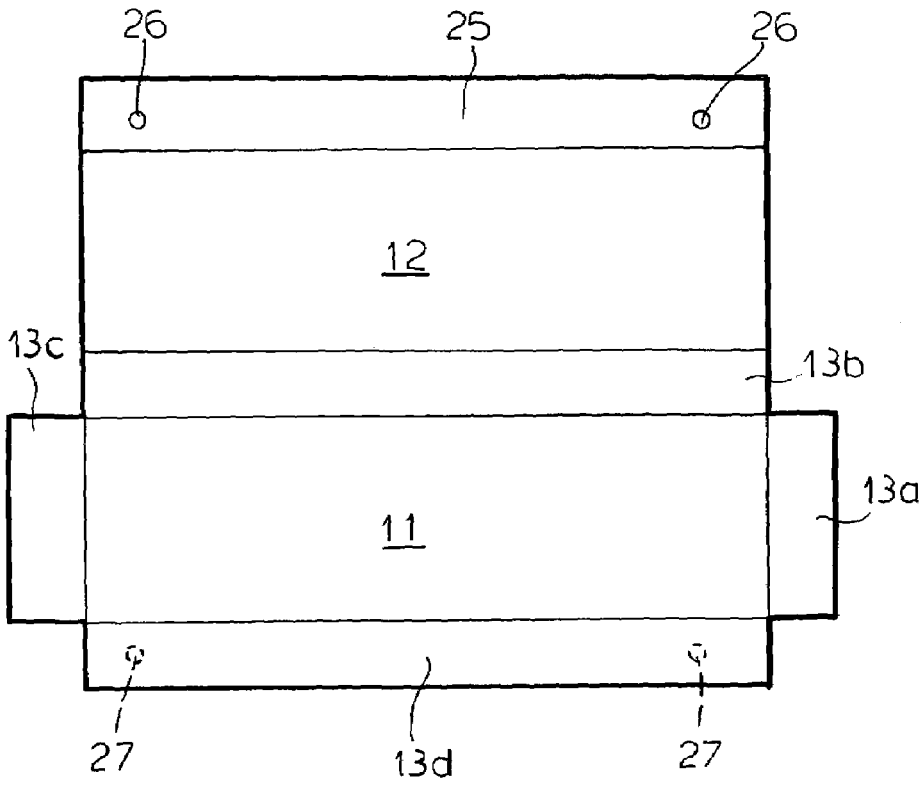
FIG. 6 is a small-scale view of the case when flattened.

The cover 12 is hinged at an axis a at an upper edge of the long side wall 13*b*, is slightly larger than the floor 11, and has a flap 25 that can be secured by catches 30*a* and 30*b* to keepers 31*a* on the front long side wall 13*d*, or by snaps as shown at 26 and 27 in FIG. 6. Mounting boards 16*a*, 16*b*, and 16*c* formed with respective rows of slots 20*a*–20*i* like the floor board 15 are secured inside the cover 12 by hook/loop strips 21*c* on the backs of the boards 15 and strips 22*c* on the long edges of the underside of the cover 12, so that these boards 16*a*–16*c* can be mounted at any desired position in the longitudinal direction $g_2$.

FIG. 6 shows how the entire box of the case 10 can be flattened out, making it extremely easy to ship and store. This case 10 can also be produced by stamping from suitable stock, and can be made at very low cost. Thus a person needing to hold a number of guns in stock or move them from show to show can easily provide a separate case for each long arm, and can even sell them with the cases without investing too much money in packaging.

Figure 3:
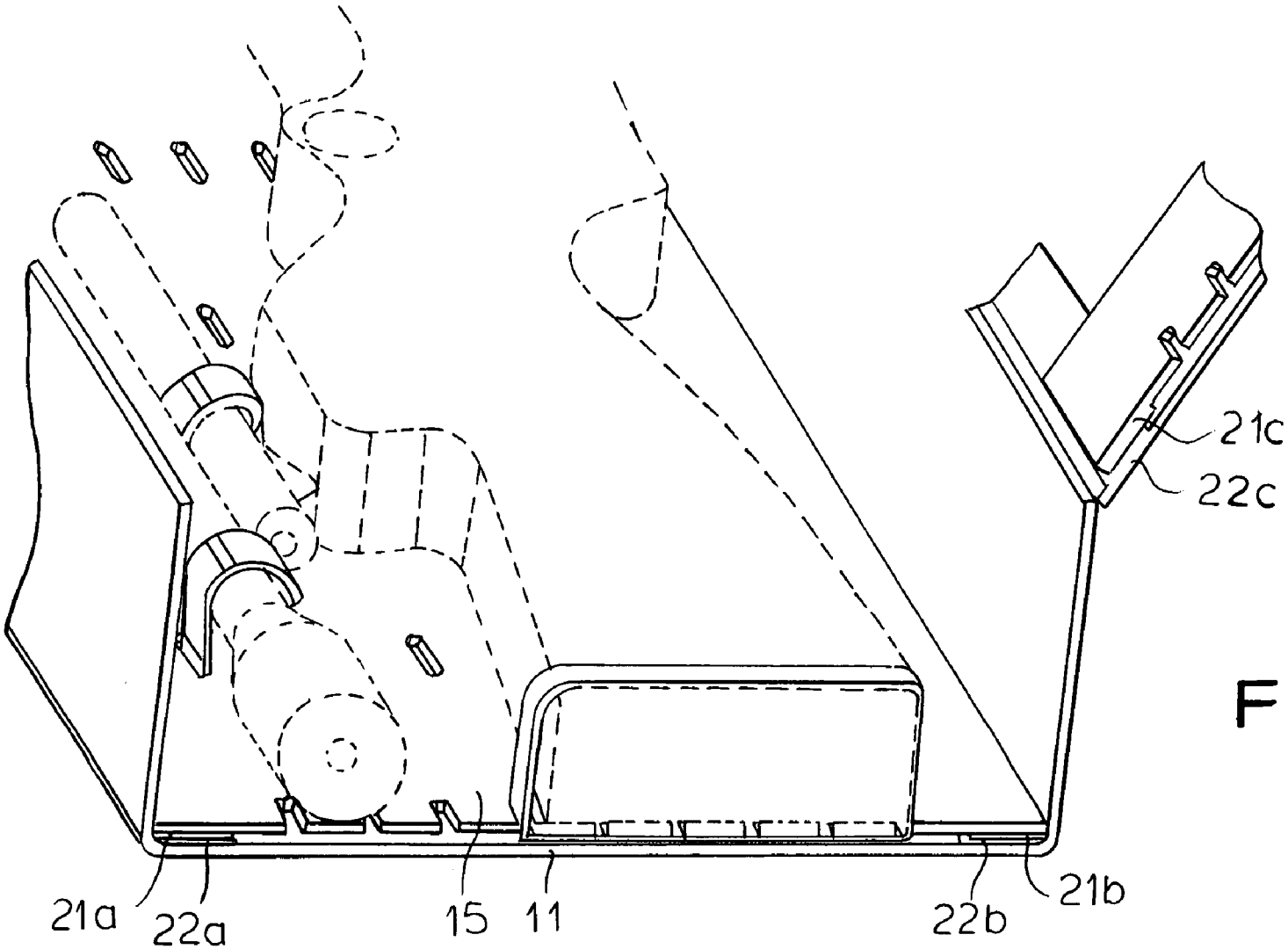
FIG. 3 is an end view of the case according to the invention with an end wall removed for clarity of view.
Figure 4:
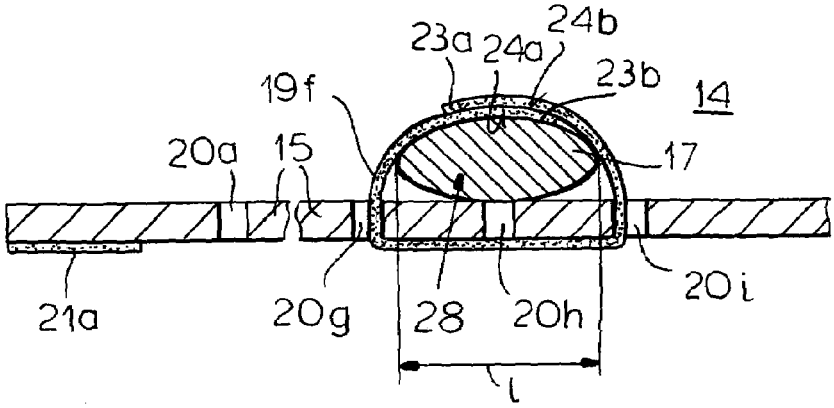
FIG. 4 is a cross section through a detail of the case.

As shown in FIG. 3 a long arm, here comprised of a stock 17 and two barrels 18*a* and 18*b* is secured in place in the compartment 14 of the case 10 by means of identical hook/loop tapes 19*a*, 19*b*, 19*c*, 19*d*, 19*e*, and 19*f*, two per part of the long arm, and each in a respective row of the slots 20*a*–20*i*. To this end as shown in detail in FIG. 4 the tape 19*f*, which is engaged over a narrow front end 28 of the stock 17, passes through two the two slots 20*g* and 20*i*, of the end row and ends 23*a* and 23*b* of this tape 19*f* and their confronting faces 24*a* and 24*b* are engaged together to hold the stock 17 tightly to the board 15. The slots 19*g* and 19*i* are selected because they are spaced apart by a distance slightly greater than a width l of the stock end 28, thereby insuring that the stock 17 will be held solidly in place. Of course the tapes 19*a*–19*d* securing the barrels 18*a* and 18*b* in place are fitted to adjacent slots, and the tape 19*e* at the wide end of the stock 17 skips more than one slot.

I claim:

1. A portable gun case comprising:

a generally rectangular floor wall having two long side edges and two short end edges bridging the side edges;

respective side and end walls projecting upward from the respective edges of the floor wall and forming an upwardly open cavity;

a top wall secured to one of the side walls and engageable down over the cavity, one of the walls being provided with a plurality of arrays each having a plurality of pairs of attachment formations spaced apart along the respective array, and a respective flexible holding tape at each of the arrays, each of the tapes being releasably securable in the respective array at any of the respective pairs of attachment formations of the respective array at locations spaced apart along the respective array and wrappable around the parts of a gun resting on the one wall and extending across the respective array to secure the gun to the one wall to accommodate guns and parts of guns of different sizes.

2. The portable gun case defined in claim 1 wherein the one wall includes a mounting board fitted to the one wall in the cavity and adapted to support parts of a gun.

3. The portable gun case defined in claim 2 wherein the tapes each have hook and loop ends that stick to each other.

4. The portable gun case defined in claim 2 wherein the attachment formations are slots through which the tapes are looped.

5. The portable gun case defined in claim 4 wherein the arrays are rows extending parallel to each other and to the short side edges.

6. The portable gun case defined in claim 5 wherein each of the slots is throughgoing and has a length equal to slightly more than a width of the tapes.

7. The portable gun case defined in claim 2 wherein the board has hook-and-loop regions engaging the tapes, releasably secured thereto, and constituting the attachment formations.

8. The portable gun case defined in claim 2 wherein the board is rigid.

9. The portable gun case defined in claim 8 wherein the board has a face turned toward the one wall and the board face and the one wall are provided with complementary hook-and-loop strips that removably secure the board to the one wall.

10. The portable gun case defined in claim 2 wherein the walls can all be folded flat.

11. The portable gun case defined in claim 10 wherein the side walls and end walls are permanently hinged on the floor wall and the top wall is permanently hinged on one of the side walls.

12. The portable gun case defined in claim 2, further comprising means for securing the cover to one of the side walls and thereby close the cavity.

* * * * *